US006389851B1

(12) United States Patent
Groshens

(10) Patent No.: US 6,389,851 B1
(45) Date of Patent: May 21, 2002

(54) CLOTH FABRIC, ITS METHOD OF MANUFACTURE AND USE

(75) Inventor: Pierrot Groshens, Flamicourt (FR)

(73) Assignee: Lainiere de Picardie (FR)

( * ) Notice: Subject to any disclaimer, the term of this patent is extended or adjusted under 35 U.S.C. 154(b) by 0 days.

(21) Appl. No.: 09/247,060

(22) Filed: Feb. 9, 1999

(30) Foreign Application Priority Data

Feb. 11, 1998 (FR) ..... 98 01627

(51) Int. Cl.[7] ..... D04B 23/12
(52) U.S. Cl. ..... 66/192; 66/195
(58) Field of Search ..... 66/169 R, 170, 66/190, 192, 193, 195, 202; 442/305, 312, 313, 314

(56) References Cited

U.S. PATENT DOCUMENTS

| | | | | | |
|---|---|---|---|---|---|
| 3,952,550 A | | 4/1976 | Niederer | 66/87 |
| 4,067,210 A | | 1/1978 | Arons et al. | 66/202 |
| 4,248,064 A | * | 2/1981 | Odham | 66/192 |
| 4,425,398 A | * | 1/1984 | Berczi | 66/193 |
| 4,518,640 A | * | 5/1985 | Wilkens | 66/192 |
| 4,615,934 A | * | 10/1986 | Ellison | 66/192 |
| 4,845,963 A | * | 7/1989 | Bell | 66/192 |
| 5,065,599 A | | 11/1991 | Groshens | 66/84 |
| 5,191,777 A | * | 3/1993 | Schnegg | 66/192 |
| 5,317,886 A | * | 6/1994 | Prahl | 66/192 |
| 5,415,007 A | * | 5/1995 | Eng | 66/192 |

FOREIGN PATENT DOCUMENTS

| | | | |
|---|---|---|---|
| DE | 412358 | 4/1995 | |
| FR | 2 671 812 | 7/1992 | D04B/21/20 |

* cited by examiner

*Primary Examiner*—Danny Worrell
(74) *Attorney, Agent, or Firm*—George T. Marcou; Kilpatrick Stockton LLP

(57) ABSTRACT

A cloth fabric of the knitted cloth type has on one of its sides reinforcing and/or stabilizing threads in the weft direction held in place on the knitted fabric by the casts of the knitted yarns, without participating in the formation of the stitch.

31 Claims, 3 Drawing Sheets

CLOTH FABRIC, ITS METHOD OF MANUFACTURE AND USE

BACKGROUND OF THE INVENTION

The invention relates to a cloth fabric.

It also relates to a method of manufacturing a cloth fabric.

It also relates to the uses of this fabric, notably in clothing and in garments including such a fabric.

Knitted cloth fabrics are well known and often used in clothing, notably because of their flexibility and elasticity.

For example, from the document FR-A-2 671 812, a tricot knitted fabric composed of three knitted threads is known, a first thread constituting the right side of the knitted fabric, a second thread, constituting the wrong side of the knitted fabric, knitted with the first thread and a third thread constituting an inconspicuous weft thread inserted between the first thread and the second thread.

Knitted fabrics however have drawbacks, in comparison notably with warp and weft woven fabrics.

Thus, knitted cloth fabrics can generally be put out of shape more than woven fabrics, owing to a more difficult to obtain and keep dimensional stability.

They also have a generally high permeability to air which can detract from comfort.

Making up, notably sewing, operations are also more difficult to carry out with knitted cloths. This is because a significant pressing off of one or more knitting threads can occur following the breaking of a thread of the contexture.

The choice of usable yarns is also more limited than in the case of warp and weft woven fabrics.

The invention therefore aims to remedy these drawbacks.

BRIEF SUMMARY OF THE INVENTION

The invention proposes a cloth fabric of the knitted cloth type, comprising a knitted fabric, preferably warp knit fabric. The fabric has, on one of the faces of the knitted fabric, an insertion of reinforcing and/or stabilizing threads extending in the weft direction held in place on the knitted fabric by the casts of the knitting yarns, without participating in the formation of the stitch.

According to other characteristics, the reinforcing and/or stabilizing threads comprise the long weft threads.

The fabric according to the invention includes a reinforcing and/or stabilizing thread in the weft direction between each row of stitches. As a variant, it includes several, for example two or three, reinforcing and/or stabilizing threads in the weft direction between each row of stitches.

According to another variant, the reinforcing and/or stabilizing threads extending in the weft direction are disposed one row of stitches out of two, three, four or more.

According to another embodiment, the fabric has in addition reinforcing and/or stabilizing threads in the warp direction.

The reinforcing and/or stabilizing threads in the warp direction comprise the capstan threads, disposed rectilinearly between the columns of stitches or disposed with a displacement of one or more columns of stitches to another.

For example, the capstan threads may be disposed in the warp direction, with a displacement corresponding to one or two columns of stitches, so as to have a cast over one or two columns of stitches.

The reinforcing and/or stabilizing threads in the warp direction are disposed between each column of stitches or, as a variant, one column of stitches out of two, three, four or more.

A reinforcing and/or stabilizing thread is disposed in the warp direction between the columns of stitches. Provision can also be envisaged of several, for example two or three, reinforcing and/or stabilizing threads between each column of stitches or one column of stitches out of two, three, four or more.

Generally, the reinforcing and/or stabilizing threads in the weft and warp directions are disposed substantially regularly. However, increase, or reduction, can be envisaged of the number of reinforcing threads at certain places in the fabric, notably depending on the destination and use of the fabric.

The knitted fabric is made from synthetic or artificial mono- or multifilament threads, and/or from synthetic or artificial fibres.

For example, the knitted fabric is made from threads and/or fibres of polyester, polyamide, notably polyamide 6 or 6.6, viscose, and derivatives and/or mixtures of these products.

The threads and/or fibres used for the knitted fabric are flat.

As a variant, they may be textured.

According to another variant, the knitted fabric is made from threads and/or fibres which include, incorporated, one or more threads and/or fibres of elastane.

The reinforcing and/or stabilizing threads in the warp and/or weft direction are made from synthetic or artificial mono- or multifilament threads and/or from synthetic or artificial fibres.

For example, the threads and/or fibres used for the reinforcing and/or stabilizing threads comprise those made from polyester, polyamide, notably polyamide 6 or 6.6, viscose, and the derivatives and/or mixtures of these products.

According co another embodiment, the reinforcing and/or stabilizing threads in the weft and/or warp direction are made from natural threads and/or fibres, for example wool, cotton, and derivatives and/or mixtures of these products.

According to another variant, the reinforcing and/or stabilizing threads in the weft and/or warp direction include, incorporated, one or more threads and/or fibres of elastane.

The reinforcing and/or stabilizing threads in the weft and/or warp direction are flat or textured.

The textured threads may be obtained by a conventional texturing technique, for example a technique of texturing by false twisting.

The textured threads may also be obtained by the air texturing technique.

According to another embodiment, the reinforcing and/or stabilizing threads in the warp and/or weft direction comprise a mixture of shrunk fibres and non-shrunk fibres.

According to the invention, the reinforcing and/or stabilizing threads in the weft and/or warp direction may be identical to one another or of different compositions and/or structures.

The number and the numbering per single ply of the threads are generally chosen according to the resilience, flexibility and volume desired for the fabric.

According to the invention, the knitted fabric is made from a weave limiting the effect of pressing off. Such weaves are for example the Simple Atlas, Reverse Atlas or Twill knitted fabric type weaves.

According to another aspect, the invention also concerns the uses of the cloth fabric according to the invention, for making garments or pieces of garments.

The cloth fabric of the invention is usable notably for making short overcoats, jackets, coats, trousers, waistcoats, or elements which are components of these.

According to yet another aspect, the invention concerns a garment of clothing including, at least in part, a cloth fabric according to the invention.

According to yet another aspect, the invention concerns a method of manufacturing a knitted cloth fabric in which:

a knitted fabric is knitted on a tricot knitting machine;

reinforcing and/or stabilizing threads in the weft direction and/or the warp direction are inserted an the knitted fabric;

the finishing of the fabric obtained is carried out, during which the fabric possibly undergoes a shrinking treatment.

The invention will be better understood from a reading of the description which follows, produced with reference to the accompanying figures.

In these figures. the weft threads are nor depicted.

Figure 5:
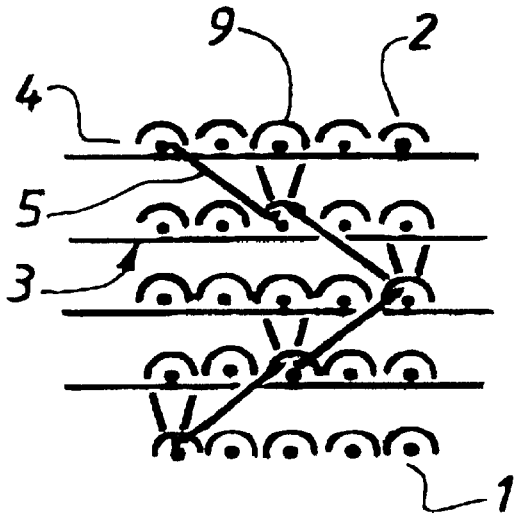

FIG. 5 is a schematic representation of the route of the threads of a fabric of the invention made from a Simple Atlas type weave.

Figure 6:
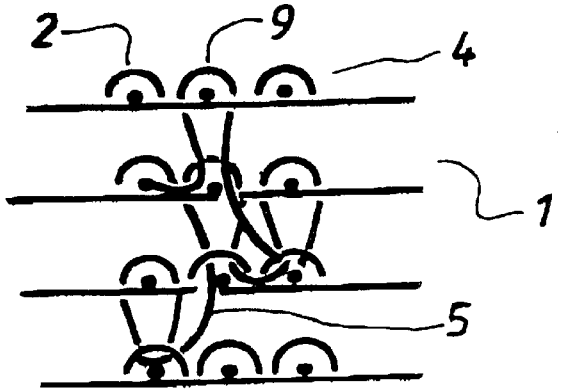

FIG. 6 is a schematic representation of the route of the threads of a fabric of the invention made with a Twill knitted fabric type weave.

Figure 8:
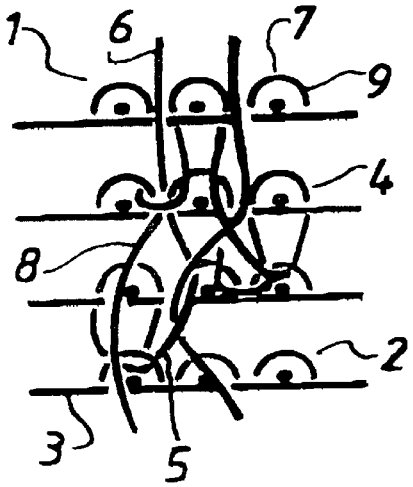
Figure 7:
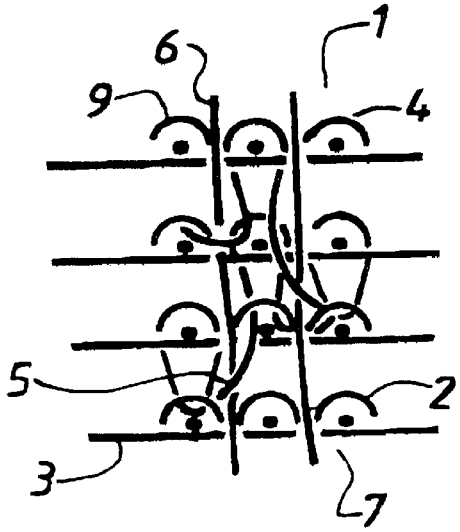

FIGS. 7 and 8 are two schematic representations of the route of the threads of a fabric of the invention made from a Twill knitted fabric type weave and having capstan threads.

In FIGS. 5. 6, 7 and 8, the route of a single knitting thread is depicted, the other knitting threads being represented only by a fragment of the knitting loops

DETAILED DESCRIPTION OF THE INVENTION

Referring now to the figures, the fabric 1 according to the invention comprises a warp knit knitted fabric 2 and long weft threads 3 extending in the weft direction, between each row 4 of stitches.

The long weft threads 3 extend rectilinearly, without participating in the formation of the stitch and have notably the function of stabilizing the structure of the stitch, of increasing the density and, therefore, the impermeability to air of the knotted fabric.

They are held in place on the knitted fabric 2 by the casts 5 of the knitting yarns.

Figure 1:
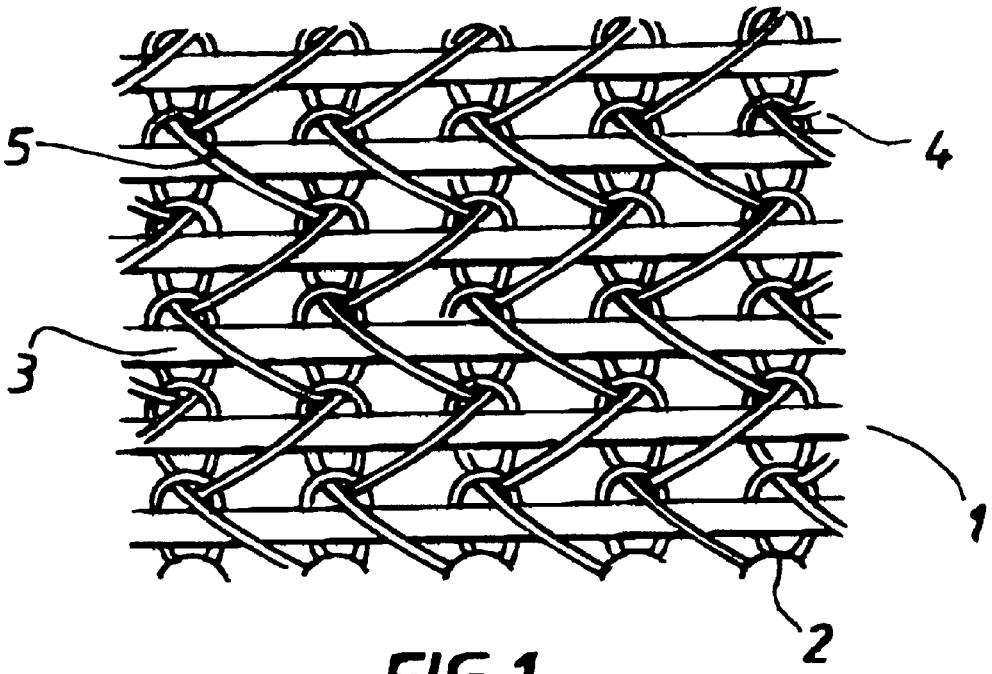
FIG. 1 depicts a schematic flat front view of an embodiment of the fabric according to the invention.

In FIG. 1, a long weft thread 3 is disposed between each row 4 of stitches.

According to another embodiment (FIG. 2), the fabric 1 has in addition capstan threads 6 extending in the warp direction, between each column 7 of stitches.

Figure 2:
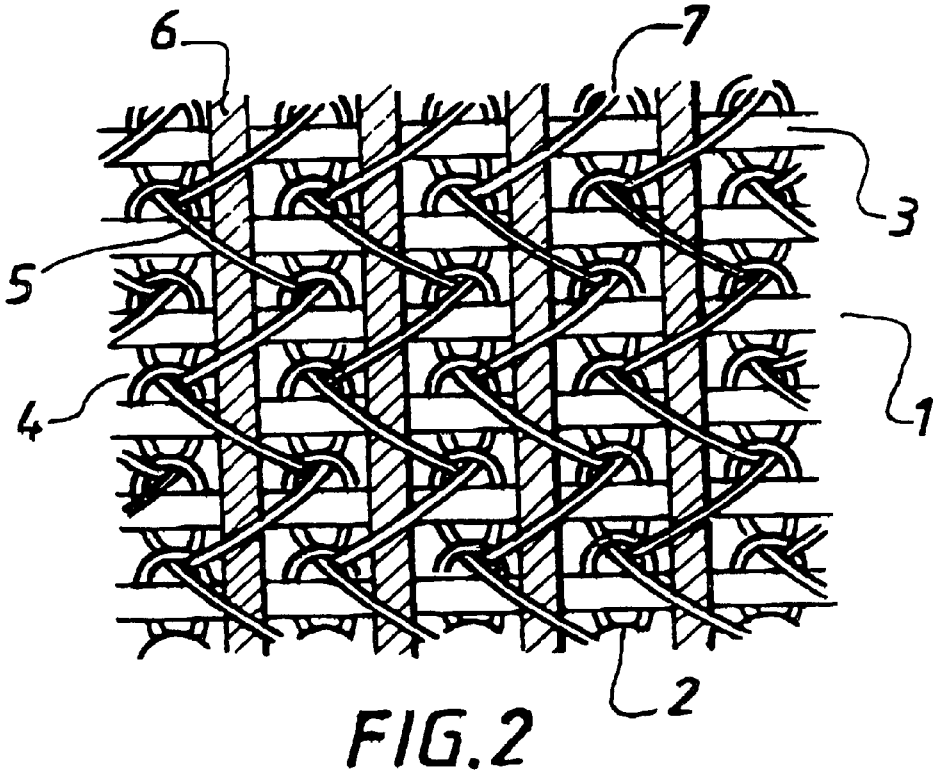
FIG. 2 depicts a schematic flat front view of another embodiment of the fabric according to the invention.

In FIGS. 1 and 2, the knitted fabric 2 is represented in a general way, with no indication of a particular weave. The knitted fabrics obtained from weaves limiting pressing off are described hereunder.

According to the embodiments depicted in FIGS. 2 and 7, the capstan threads 6 are disposed rectilinearly, between each column 7 of stitches of the knitted fabric 2, without participating in the formation of the stitch, and further increase the stability and density of the knitted fabric.

The capstan threads 6 are held in place on the knitted fabric 2 by the casts 5 of the knitting yarns 9.

According to another embodiment depicted in FIG. 8, the capstan threads 6 are disposed in the knitted fabric 2 having a displacement 8 (or cast) over one column 7 of stitches, at each row 4 of stitches, each displacement a being made in the opposite direction from the previous one.

According to this embodiment, the long weft threads 3 are disposed in the knitted fabric 2 between each row 4 of stitches and are held in place by the casts 5 of the knitting yarns 9. The long weft threads 3 pass under the casts 5 and over the knitting loops 2.

Examples of threads usable for the knitted fabric, the capstan threads and the long weft threads are notably those marketed under the names COOLMAX (registered trade mark) by the Du Pont company of Nemours, France; LYOCELL and NEWCELL (trade marks registered by the Akzo Nobel company, France).

The weave used for making the knitted fabric 2 is chosen so as to limit the pressing off of the knitted fabric, for example following the breaking of a knitting yarn.

Limitation of the pressing off is also reinforced by the presence of the weft threads.

Figure 3:
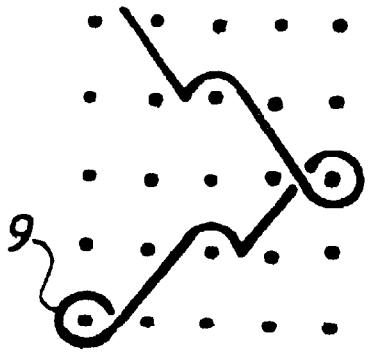
FIGS. 3 and 4 depict schematically the weaving process graphics for knitting yarns corresponding respectively to Simple Atlas and Reverse Atlas type weaves In these figures, each point corresponds to the intersection of two threads, the horizontal rows of points representing the weft threads and the vertical rows of points representing the warp threads.

The weave is for example a Simple Atlas type weave in which the process of weaving each knitting yarn 9 advances several times in succession in the same direction and then comes back in the opposite direction (FIG. 3).

Figure 4:
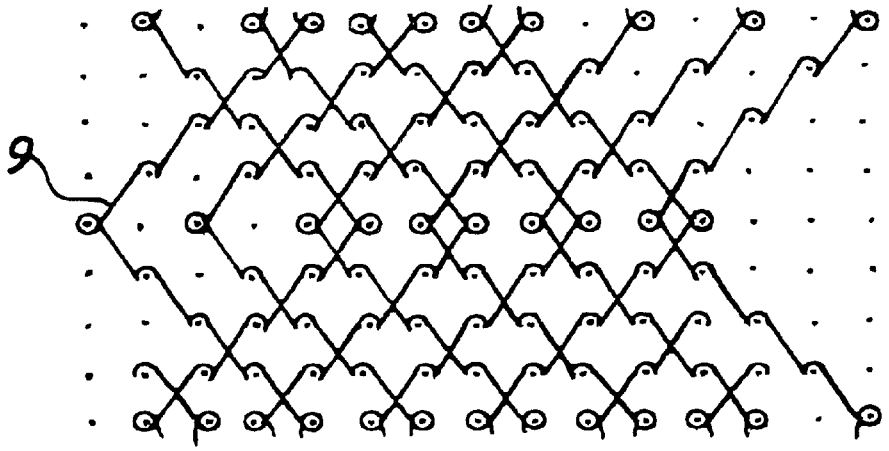

According to another variant, the weave is of the Reverse Atlas type in which two neighbouring threads 9 forming the knitted fabric advance in the same manner but inverted (FIG. 4).

According to yet another variant, the weave is of the Twill knitted fabric type, in which a diagonal effect is obtained by an offset of one or more threads 9 of the knitted fabric at each row of stitches (FIG. 6).

FIG. 5 shows an embodiment of the fabric of the invention, comprising a knitted fabric 2 knitted from threads 9 using a Simple Atlas type weave and including long weft threads 3 inserted between each row 4 of stitches held in place by the casts 5 of the threads 9 and passing under the casts 5 of the threads 9 and over the loops formed by the threads 9.

According to another embodiment, the fabric comprises long weft threads and a knitted fabric, knitted using a Reverse Atlas type weave, corresponding to the following numerical representation:

| BI | BII |
|---|---|
| 1 | 2 |
| 0 | 3 |
| 1 | 2 |

-continued

| BI | BII |
|---|---|
| 1 | 2 |
| 2 | 1 |
| 2 | 1 |
| 2 | 1 |
| 3 | 0 |
| 2 | 1 |
| 2 | 1 |
| 1 | 2 |
| 1 | 2 |

FIG. 6 shows another embodiment of the fabric 1 of the invention, comprising a knitted fabric 2 made from threads 9 and long weft threads 3. The long weft threads 3, inserted between each row 4 of stitches, are held on the knitted fabric 2 by the casts 5 of the threads 9. passing under the casts 5 and over the loops of the knitted fabric 2.

The knitted fabric is obtained, according to this embodiment, using a Twill knitted fabric type weave, corresponding to the following numerical representation:

| |
|---|
| — |
| 2 |
| 0 |
| 0 |
| — |
| 1 |
| 3 |
| 3 |
| — |

The embodiment of the fabric according to the invention depicted in FIG. 8 is obtained from threads knitted using a Twill knitted fabric type weave, corresponding to the following numerical representation:

| BI | BII |
|---|---|
| 1 | 2 |
| 1 | 0 |
| 1 | 0 |
| — | — |
| 0 | 1 |
| 0 | 3 |
| 0 | 3 |

in which the bar BI is used for a capstan thread and the bar BII is used for a knitting thread.

The fabric of the invention can be manufactured using a tricot knitting machine, known per se, for example a "Raschel" type knitting machine.

The operation of these machines is known per se. Generally, the reinforcing and stabilizing threads are laid down in the weft and/or warp direction between the needle bed and the fall plate One or more needles cooperate in a known manner with guide bars to make the knitted fabric. inserting the reinforcing and/or stabilizing threads After the knitting operation, the fabric may undergo finishing operations which are conventional in themselves, with a view to giving it an elasticity, colour and stability adapted to its destination and use.

Such treatments include for example shrinking treatments, for example with heat, which bring about a reduction in the dimensions of the fabric.

What is claimed is:

1. A cloth fabric for a garment comprising a knitted fabric, and on one side of the knitted fabric an insertion of reinforcing or stabilized threads only in a weft direction, the threads held in place on the knitted fabric by casts of knitting yarns, the threads not forming part of a stitch, wherein a thread type is chosen such that the threads provide the knitted fabric of the garment a desired flexibility.

2. The fabric according to claim 1, characterized in that the reinforcing or stabilizing threads comprise long weft threads.

3. The fabric according to claim 1, characterized in that it has in addition an insertion of reinforcing or stabilizing threads extending in a warp direction.

4. The fabric according to claim 3, characterized in that the reinforcing or stabilizing threads in the warp direction comprise capstan threads.

5. The fabric according to claim 4, characterized in that the reinforcing or stabilizing threads in the warp direction are disposed rectilinearly between columns of stitches.

6. The fabric according to claim 4, characterized in that the reinforcing or stabilizing threads in the warp direction are disposed with a displacement of at least one column of stitches between the threads, so as to have a cast over at least one column of stitches.

7. The fabric according to claim 6, characterized in that the reinforcing or stabilizing threads in the warp direction are disposed with a displacement of two columns of stitches between the threads, so as to have a cast over two columns of stitches.

8. The fabric according to claim 3, characterized in that it includes reinforcing or stabilizing threads in the warp direction between each column of stitches.

9. The fabric according to claim 3, characterized in that it includes reinforcing or stabilizing threads in the warp direction, with at least one thread between each column of stitches.

10. The fabric according to claim 1, characterized in that it includes at least one reinforcing or stabilizing threads in the weft direction between each row of stitches.

11. The fabric according to claim 1, characterized in that it includes reinforcing or stabilizing threads in the weft direction, with at two threads between each row of stitches.

12. The fabric according to claim 1, characterized in that it includes two reinforcing or stabilizing threads in the warp direction between each column of stitches.

13. The fabric according to claim 1, characterized in that it includes three reinforcing or stabilizing threads in the weft direction between each row of stitches.

14. The fabric according to claim 1, characterized in that the knitted fabric limits the effect of pressing off.

15. The fabric according to claim 14, characterized by a Simple Atlas, Reverse Atlas or Twill knitted fabric type.

16. The fabric according to claim 1, characterized in that the knitted fabric is made from synthetic or natural mono- or multifilament threads, or from natural or synthetic fibers.

17. The fabric according to claim 16, characterized in that the knitted fabric is made from flat or textured fibers or threads.

18. The fabric according to claim 16, characterized in that the knitted fabric is made from threads or fibers of polyamide, polyester, viscose, and derivatives or mixtures of these products.

19. The fabric according to claim 16, characterized in that the threads or fibers include at least one thread or fiber of elastane.

20. The fabric according to claim 16, characterized in that the reinforcing or stabilizing threads in the warp or weft direction are made from synthetic or artificial mono- or multifilament threads or from synthetic or artificial fibers.

21. The fabric according to claim 20, characterized in that the reinforcing or stabilizing threads in the warp or weft direction are made from flat or textured fibers or threads.

22. The fabric according to claim 20, characterized in that the reinforcing or stabilizing threads in the warp or weft direction are made from threads or fibers of polyamide, viscose, and the derivatives or mixtures of these products.

23. The fabric according to claim 1, characterized in that the reinforcing or stabilizing threads in the warp or weft direction are made from natural threads or fibers.

24. The fabric according to claim 23, characterized in that the reinforcing or stabilizing threads in the warp or weft direction are made from threads or fibers of wool, cotton, and the derivatives or mixtures of these products.

25. The fabric according to claim 20, characterized in that the reinforcing or stabilizing threads in the warp or weft direction include at least one thread or fiber of elastane.

26. The fabric according to claim 20, characterized in that the reinforcing or stabilizing threads in the warp or weft direction comprise a mixture of shrunk fibers and non-shrunk fibers.

27. The fabric according to claim 20, characterized in that the reinforcing or stabilizing threads are identical to one another.

28. A garment of clothing including a cloth fabric comprising a knitted fabric, and on one side of the knitted fabric an insertion of reinforcing or stabilized threads extending only in a weft direction, the threads being held in place on the knitted fabric by casts of knitted yarns, the threads not forming part of a stitch, wherein a thread type is chosen such that the threads provide the garment a desired flexibility.

29. A method for manufacturing a garment comprising making garments or pieces of garments with the cloth fabric wherein the cloth fabric comprises a knitted fabric, and on one side of the knitted fabric an insertion of reinforcing or stabilizing threads extending only in a weft direction, the threads held in place on the knitted fabric by casts of knitting yarns, the threads not forming part of a stitch, wherein a thread type is chosen such that the threads provide the knitted fabric of the garment a desired flexibility.

30. The method according to claim 29, wherein the garments are overcoats, jackets, trousers, waistcoats, coats, or elements which are components of these.

31. A method of manufacturing a knitted cloth fabric for a garment, comprising:

knitting on a tricot knitting machine a knitted fabric;

inserting reinforcing or stabilizing threads only in the weft direction on one side of the knitted fabric, the threads held in place on the knitted fabric by casts of knitting yarns, wherein the threads are chosen such that the knitted fabric of the garment has a desired flexibility; and finishing of the fabric.

* * * * *